US005927406A

United States Patent [19]

Kadoche

[11] Patent Number: 5,927,406

[45] Date of Patent: Jul. 27, 1999

[54] FIRE PROTECTION INSTALLATION INVOLVING A NORMALLY DRY NETWORK OF SPRINKLERS

[76] Inventor: Maurice Kadoche, 42 Avenue Corot, 93470 Coubron, France

[21] Appl. No.: 08/810,616

[22] Filed: Feb. 28, 1997

Related U.S. Application Data

[63] Continuation-in-part of application No. 08/526,489, Sep. 11, 1995, abandoned.

[30] Foreign Application Priority Data

Sep. 13, 1994 [FR] France ..... 94 10892

[51] Int. Cl.[6] ..... A62C 35/62

[52] U.S. Cl. ..... 169/17; 169/20

[58] Field of Search ..... 169/17, 19, 20, 169/21, 22

[56] References Cited

U.S. PATENT DOCUMENTS

| | | | |
|---|---|---|---|
| 367,390 | 8/1887 | Granger | 169/17 |
| 2,699,217 | 1/1955 | Elmenhorst | 169/17 |
| 2,865,457 | 12/1958 | Jensen | 169/17 |
| 3,759,331 | 9/1973 | Livingston | 169/17 |
| 5,010,959 | 4/1991 | Lostoski | 169/37 |

FOREIGN PATENT DOCUMENTS

| | | |
|---|---|---|
| 209388 | 1/1987 | European Pat. Off. . |
| 2225927 | 11/1974 | France . |

OTHER PUBLICATIONS

Pp. 18 & 19 of a commercial booklet from Viking Corporation, 210N Industrial Park Road, Hastings, Michigan, USA 49058, printed in Feb., 1992.

*Primary Examiner*—Andrew C. Pike
*Attorney, Agent, or Firm*—Marshall & Melhorn

[57] ABSTRACT

A fire protection installation of the type comprising a normally dry network of sprinklers is, whenever the dry network of sprinklers is put to atmospheric pressure due to said network of sprinklers being opened, fed with water via a control station connected to a supply of water under pressure, wherein the network of sprinklers is evacuated and is normally maintained at a pressure that is lower than atmospheric pressure.

7 Claims, 4 Drawing Sheets

FIRE PROTECTION INSTALLATION INVOLVING A NORMALLY DRY NETWORK OF SPRINKLERS

CROSS REFERENCE TO RELATED APPLICATION

This application is a continuation-in-part of U.S. application Ser. No. 08/526,489, filed Sep. 11, 1995, now abandoned.

BACKGROUND OF THE INVENTION

1. Field of the Invention

The present invention relates to a fire protection installation of the type comprising a normally dry network of sprinklers suitable, whenever the dry network of sprinklers is put to atmospheric pressure due to said network of sprinklers being opened, for being fed with water via a control station that is connected to a supply of water under pressure.

2. Summary of Prior Art

The purpose of a sprinkler installation is to detect the seat of a fire, to raise the alarm, and to extinguish it as it begins, or at least contain it in such a manner as to ensure that it can be properly extinguished by means available in the establishment fitted with said installation or by the fire brigade.

In premises where there is no risk of freezing, the sprinkler network may be "wet", i.e. it may be permanently filled with water.

However, when there is a risk of freezing, the sprinkler network must be "dry", i.e. empty of water, since the freezing of a wet installation can damage that installation and thus give rise to a risk of water damage, and above all, to a risk of the installation being out of operation for a greater or lesser length of time as required for bringing it back into operation.

In dry installations, the sprinkler network is maintained under air that is permanently compressed. A drop in pressure in the pressurized air sprinkler network due to a sprinkler opening because it has detected a fire causes a valve in a control station to open, thereby triggering the alarm and putting the sprinkler network into communication with the supply of water under pressure.

The drawback of present dry installations is that the air contained in the network is at a pressure of at least 2 bars. This gives rise to a relatively lengthy period of time to exhaust air from the network after it has opened, and in certain installations that can be quite unacceptable, and it also requires the installation to be provided with a compressor device enabling such pressures to be obtained. The high pressure also gives rise to condensation inside the sprinkler network, thereby leading back to the risk of ice forming therein due to freezing.

OBJECT AND SUMMARY OF THE INVENTION

The object of the present invention is to propose an installation of the above-mentioned type, in which putting a dry sprinkler network to atmospheric pressure gives rise to a quicker reaction time.

According to the invention, this object is achieved by the fact that the network of sprinklers is evacuated, and is normally maintained at a pressure that is lower than atmospheric pressure.

Advantageously, the control station comprises a three-port valve body containing a nonreturn valve member, said valve body having a water inlet duct connected to the water supply and normally closed by the valve member, a control chamber separated from the inlet duct by the valve member, an outlet duct connected to the evacuated network of sprinklers and suitable for being put into communication with the inlet duct by displacement of the valve member, and a first branch connecting the inlet duct to the control chamber and enabling equal pressures to be maintained in the inlet duct and the control chamber so that the valve member closes the inlet duct and isolates the outlet duct, and an actuator is provided in a second branch connecting the control chamber to the evacuated network of sprinklers, said actuator being suitable for keeping said second branch closed so long as the network of sprinklers is evacuated, and for permanently opening said second branch when the pressure in the network of sprinklers exceeds a predetermined threshold pressure below atmospheric pressure, thereby causing the pressure in the control chamber to drop and the valve member to open.

The actuator comprises a cylinder body having an axial orifice connected to the evacuated sprinkler network and a radial orifice connected to the control chamber, a plug slidably mounted in said cylinder body and suitable for closing both the axial orifice and the radial orifice when in a closed position and for putting them into communication with each other when in an open position, resilient means interposed between the plug and the cylinder body and designed to urge the plug relative to cylinder body away from its closed position towards its open position whenever the pressure in the evacuated sprinkler network exceeds said predetermined threshold pressure, and an external handle connected to the plug by a control rod enabling the plug to be moved into its closed position while the sprinkler network is being evacuated, and also making it possible to trigger opening of the valve member manually.

The cylinder body of the actuator further includes a second radial orifice connected to a water alarm network and suitable for being closed by the plug when in its closed position and for communicating with the control chamber when the plug is in its open position.

The present invention also relates to a sprinkler specially adapted for the installation of the invention and of the type comprising a coupling for coupling to a duct, an outlet orifice provided in said coupling, a bracket secured to the coupling, and a fuse disposed between the orifice and the bracket, and closing said orifice.

According to the invention, means are provided between the outlet orifice of the sprinkler and the fuse for positively opening said orifice in the event of the fuse being destroyed.

Said means include resilient means interposed between said orifice and said fuse. The resilient means comprise a compression spring bearing against a collar provided in the orifice of the sprinkler and against a tee closing the orifice and having a cradle for supporting the fuse.

BRIEF DESCRIPTION OF THE DRAWINGS

Other advantages and characteristics of the invention appear on reading the following description given by way of example and made with reference to the accompanying drawings, in which.

DETAILED DESCRIPTION OF THE PREFERRED EMBODIMENT

Figure 1:
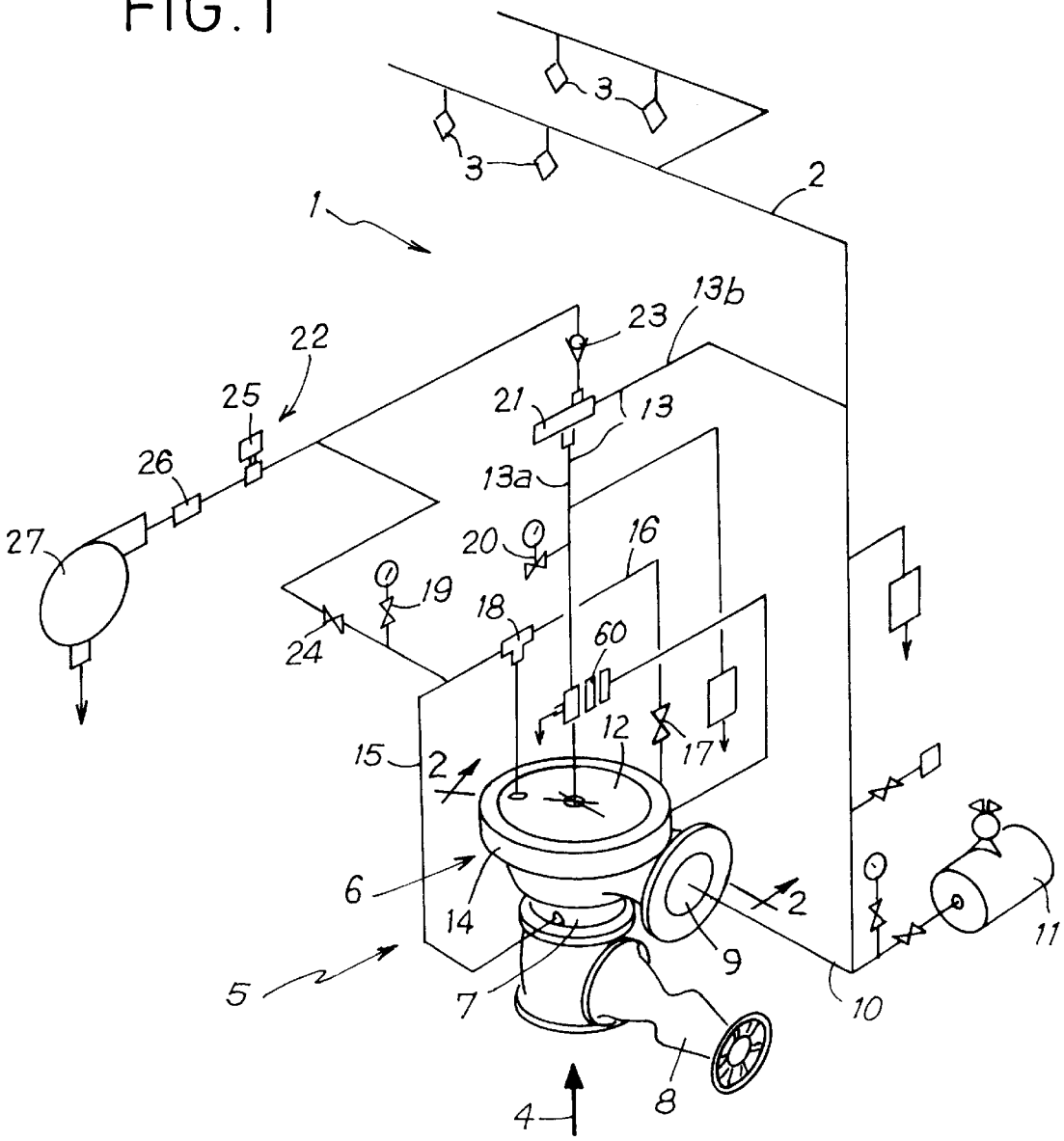
FIG. 1 is a diagram of a fire protection installation of the present invention.

In FIG. 1, reference 1 designates a fire protection installation which includes an evacuated network 2 of sprinklers 3 suitable for being connected to a supply 4 of water under pressure via a control station 5.

Figure 2:
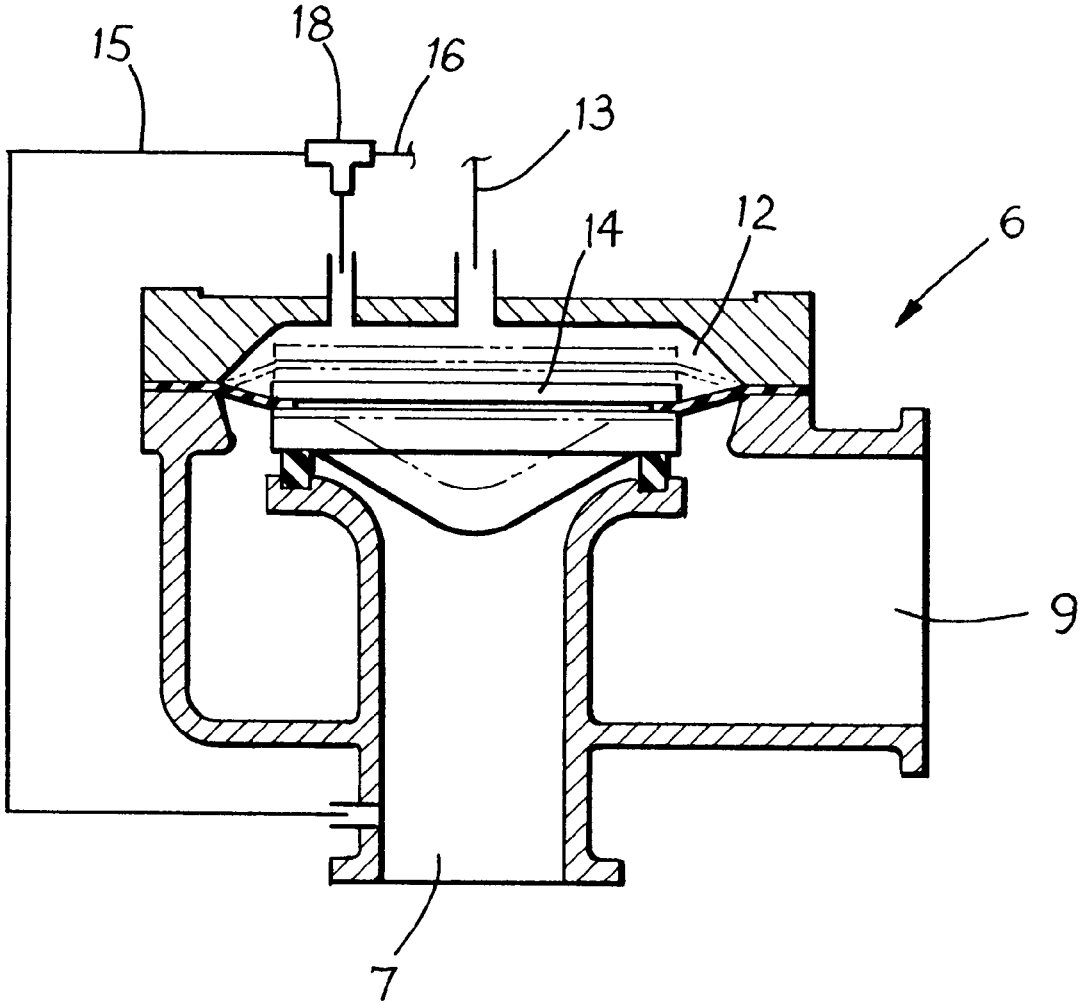
FIG. 2 is a vertical section taken along the line 2—2 through the three-port valve of FIG. 1.

The control station 5 comprises, in particular, a deluge type three-port valve 6 having an inlet duct 7 connected to the water supply 4 via a stop cock 8, an outlet duct 9 communicating with the sprinkler network 2 via a duct 10 connected to a vacuum pump 11, and an upper control chamber 12 connected to the duct 10 by a second branch 13 in which an actuator 21 is provided to control opening of a nonreturn valve member in the form of a clapper 14 disposed inside the valve 6 and normally closing the inlet duct 7 and the outlet duct 9 as shown in solid line in FIG. 2. The open position of the valve member or clapper 14 is shown in dotted line in FIG. 2.

When the valve member 14 is in its normal, closed position, the inlet duct 7 is not in communication with the outlet duct 9.

A first branch 15 connects the inlet duct 7 to the control chamber 12 so that, when the valve member 14 is in its normal position, i.e., its closed position, the same pressure is maintained in the control chamber 12 as in the inlet duct 7. This first branch 15 also communicates with the supply 4 of water under pressure via a duct 16 that is fitted with a valve 17 for priming the valve 6. A calibrated orifice 18 is provided where the duct 16 connects to the first branch 15. A pressure gauge 19 enables the pressure in the first branch 15 to be measured, and a second pressure gauge 20 enables the water pressure in the second branch 13 to be measured between the actuator 21 and the control chamber 12.

The second branch 13 is connected to a water alarm circuit 22 via the actuator 21 and a nonreturn valve 23. The water alarm circuit 22 may also be put into communication with the first branch 15 via a valve 24 for the purpose of testing that the alarm circuit 22 is operating properly.

When the installation 1 is in its normal condition, the actuator 21 closes the second branch 13 and the valve member 14 closes the outlet duct 9. In this way, the sprinkler network 2 and the duct 10 are disconnected from the supply 4 of water under pressure and can be evacuated by the vacuum pump 11. The water alarm circuit 22 is also dry.

Reference 25 designates an alarm pressure switch, reference 26 a strainer, and reference 27 a water alarm motor.

Figure 3:
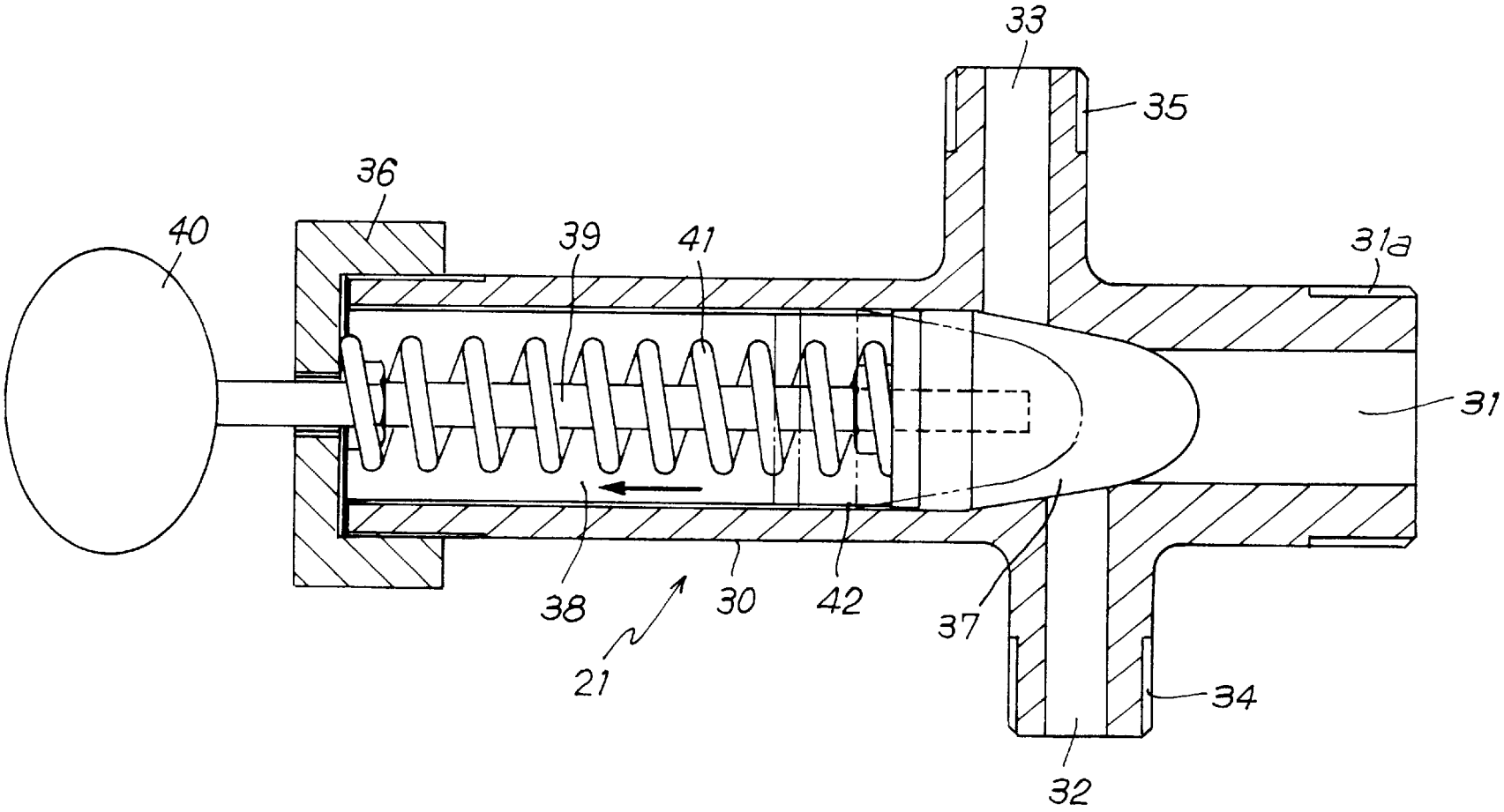
FIG. 3 is a detail view on a larger scale showing the control actuator of the installation in section.
Figure 4:
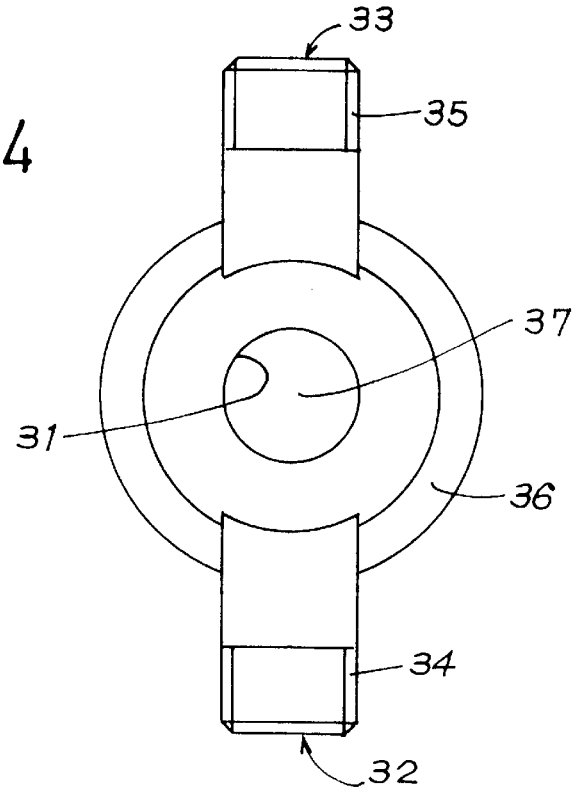
FIG. 4 is an axial view of the FIG. 3 actuator.

FIGS. 3 and 4 show the actuator 21 in detail.

The actuator comprises a cylinder body 30 having an axial orifice 31 provided in a coupling 31*a* with a duct 13*b* leading to the duct 10, and two diametrically opposite radial orifices 32 and 33 provided in couplings 34 and 35 respectively coupled with a duct 13*a* leading to the control chamber 12 and with the water alarm circuit 22. The end of the cylinder body 30 opposite from its axial orifice 31 is closed by a knurled cap 36. A plug 37 is slidably mounted in the internal cavity 38 of the cylinder body 30. The plug 37 is secured to a rod 39 that passes through the cap 36 and that carries a handle 40 at its outside end. A traction spring 41 has one of its ends held by the cap 36 and its other end held by the plug 37. A cylindrical sealing membrane 42 is interposed between the plug 37 and the cap 36. The ducts 13*a* and 13*b* constitute the above-described second branch 13. The internal cavity 38 between the plug 37 and the cap 36 is normally at atmospheric pressure.

The plug 37 can take up two positions: a closed position as shown in FIG. 3, where the plug closes all three orifices 31, 32, 33; and an open or triggered position (shown in dotted line in FIG. 3) in which the plug 37 is held towards the cover 36 by the traction spring 41, with the orifices 31, 32, 33 then communicating with one another. The movement of the plug 37 into the open position is indicated in FIG. 3 by the direction arrow.

Figure 5:
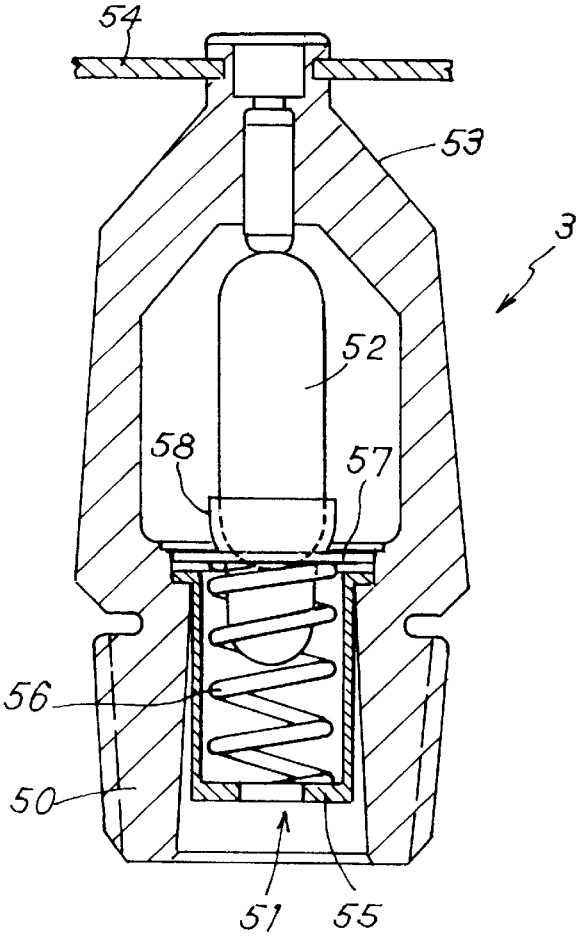
FIG. 5 is a section through a sprinkler of the invention.
Figure 6:
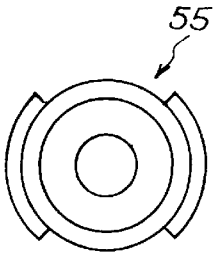
FIG. 6 shows the collar of the sprinkler.

FIGS. 5 and 6 show a sprinkler 3 for use in the installation 1 of the invention. The sprinkler 3 includes a coupling 50 for fixing to the pipework of the network 2, which coupling has a central orifice 51 that is normally closed by a fuse 52, e.g., a bulb, bearing against a bracket 53 that is secured to the coupling 50, and a deflector 54 that is fixed on the bracket 53 facing the orifice 51. A collar 55 is mounted in the orifice 51 and serves as an abutment for a first end of a compression spring 56 whose other end bears against the bottom face of a tee 57 that normally closes the orifice 51 and that has, on its outside face, a cradle 58 for supporting the base of the bulb. When clamped on the fuse 51, the tee 57 and the spring 56 are under compression.

When the temperature of ambient air rises above a temperature that is determined as a function of the type of fuse 52, the fuse bursts and the spring 56 relaxes, thereby ejecting the tee 57, and thus connecting the sprinkler network 2 to atmospheric pressure.

The traction spring 41 in the actuator 21 is calibrated so that when the sprinkler network 2 is at a pressure that is lower than atmospheric, then the suction in the duct 13*b* is capable of holding the plug 37 in its closed position, and so that when the pressure in the duct 13*b* increases to approach atmospheric pressure, due to a sprinkler fuse 52 breaking, the plug 37 is moved towards its open position under force from the traction spring 41 and from the pressure difference between the orifice 31 and the cavity 38.

When the actuator 21 is in its position for opening the second branch 13, the pressure in the control chamber 12 drops suddenly and the valve member 14 opens, supplying water to the sprinkler network 2 via the outlet duct 9 and the duct 10. The duct 13*b* also fills with water, as does the alarm circuit 22. Thereafter, the actuator 21 remains automatically in its open position.

The procedure for readying the installation 1 for operation is as follows: The stop cock 8 is closed, the vacuum pump 11 is put into operation, and the plug 37 is pressed against the orifice 31 by pushing against the handle 40. Once the suction in the sprinkler network 2 is sufficient to hold the actuator 41 in its closed position, the handle 40 is released and the valve 17 is opened to put the control chamber 12 under pressure. Equilibrium within the valve 6 and closure of the clapper 14 are obtained via the safety valve 60 and the calibrated orifice 18. Once identical pressures are indicated in the inlet duct 7 and in the control chamber 12, by readings of the pressure gauges 19 and 20, the valve 6 is ready for operation. It then remains merely to open the stop cock 8. The pressure in the sprinkler network 2 is about 0.6 bars below atmospheric pressure.

I claim:

1. A fire protection installation comprising a control station connected to a supply of water under pressure and a normally dry network of sprinklers for, whenever the dry network of sprinklers is put to atmospheric pressure due to said network of sprinklers being opened, being fed with the water from said supply thereof via said control station, wherein the network of sprinklers is evacuated and is normally maintained at a pressure that is lower than the atmospheric pressure, wherein the control station comprises a three-port valve body containing a nonreturn valve member, said valve body having a water inlet duct connected to the water supply and normally closed by the valve member, a control chamber separated from the inlet duct by the valve member, an outlet duct connected to the evacuated network of sprinklers for being put into communication with the inlet duct by displacement of the valve member, a first branch connecting the inlet duct to the control chamber and enabling equal pressures to be maintained in the inlet duct and the control chamber so that the valve member closes the inlet duct and isolates the outlet duct, and a second branch connecting the control chamber to the evacuated network of sprinklers and wherein said fire protection installation further comprises an actuator in said second branch for keeping said second branch closed so long as the network of sprinklers is evacuated, and for permanently opening said second branch when the pressure in the network of sprinklers exceeds a predetermined threshold pressure below the atmospheric pressure, thereby causing the pressure in the control chamber to drop and the valve member to open.

2. An installation according to claim 1, wherein the actuator comprises a cylinder body having an axial orifice connected to the evacuated sprinkler network and a radial orifice connected to the control chamber, a plug slidably mounted in said cylinder body for closing both the axial orifice and the radial orifice when in a closed position and for putting the axial orifice and the radial orifice into communication with each other when in an open position, resilient means interposed between the plug and the cylinder body for urging the plug relative to the cylinder body away from the closed position thereof towards the open position thereof whenever the pressure in the evacuated sprinkler network exceeds said predetermined threshold pressure, and an external handle connected to the plug by a control rod for enabling the plug to be moved into the closed position thereof while the sprinkler network is being evacuated.

3. An installation according to claim 2, wherein the cylinder body of the actuator further includes a second radial orifice connected to a water alarm network for being closed by the plug when in the closed position thereof and for communicating with the control chamber when the plug is in the open position thereof.

4. An installation according to claim 1, in which each sprinkler of the evacuated sprinkler network includes a fuse interposed between a bracket and a water outlet orifice of said sprinkler, and means between said outlet orifice and said fuse for positively opening said orifice in an event of the fuse being destroyed.

5. An installation according to claim 4, wherein the means for positively opening said orifice thereof include resilient means interposed between said orifice and said fuse.

6. An installation according to claim 5, wherein the resilient means comprise a compression spring bearing on a collar provided in the orifice of the sprinkler thereof and against a tee closing said orifice thereof, and said tees have a support cradle for the fuse thereof.

7. An installation according to claim 1, further including means for reducing the pressure in the evacuated sprinkler network.

* * * * *